US006147623A

United States Patent [19]

Rippen

[11] Patent Number: 6,147,623

[45] Date of Patent: Nov. 14, 2000

[54] SMART CROSS PROGRAMMABLE VEHICLE AND PEDESTRIAN SIGNAGE WITH ELECTRONIC DISPLAY AND INFRARED REMOTE CONTROL

[76] Inventor: Craig R. Rippen, 9400 S. 589 West, Sandy, Utah 84070

[21] Appl. No.: 09/379,208

[22] Filed: Aug. 20, 1999

Related U.S. Application Data

[60] Provisional application No. 60/097,425, Aug. 20, 1998.

[51] Int. Cl.[7] ..... G08G 1/095

[52] U.S. Cl. ..... 340/908; 340/907; 340/908.1; 340/925; 40/449; 40/586

[58] Field of Search ..... 340/908, 907, 340/908.1, 925, 702, 540, 330, 944, 912; 345/1; 40/449, 586

[56] References Cited

U.S. PATENT DOCUMENTS

| | | | |
|---|---|---|---|
| 2,564,170 | 8/1951 | Nusbaum et al. | 177/329 |
| 2,612,548 | 9/1952 | Swanson | 177/329 |
| 3,867,718 | 2/1975 | Moe | 340/31 |
| 4,226,040 | 10/1980 | Carroll et al. | 40/610 |
| 4,271,408 | 6/1981 | Teshima et al. | 340/702 |
| 4,857,921 | 8/1989 | McBride et al. | 340/912 |
| 4,928,415 | 5/1990 | Walters | 40/610 |
| 4,999,937 | 3/1991 | Bechtold | 40/610 |
| 5,023,607 | 6/1991 | Staten | 340/908.1 |
| 5,128,670 | 7/1992 | Jackson et al. | 340/907 |
| 5,422,638 | 6/1995 | Singer et al. | 340/908.1 |
| 5,493,292 | 2/1996 | Fanslow et al. | 340/908 |
| 5,521,578 | 5/1996 | DelValle | 340/330 |
| 5,654,705 | 8/1997 | Houten et al. | 340/944 |
| 5,680,121 | 10/1997 | Shiozaki et al. | 340/908.1 |
| 5,755,051 | 5/1998 | Zumbuhl | 40/586 |
| 5,760,686 | 6/1998 | Toman | 340/540 |
| 5,900,826 | 5/1999 | Farber | 340/908 |
| 5,909,971 | 6/1999 | Tijanic | 40/449 |
| 5,914,698 | 6/1999 | Nicholson et al. | 345/1 |
| 5,959,554 | 9/1999 | Armstrong et al. | 340/908 |

*Primary Examiner*—Jeffery A. Hofsass
*Assistant Examiner*—Phung Nguyen
*Attorney, Agent, or Firm*—Richard R. Mybeck

[57] ABSTRACT

A smart cross electronic traffic sign for the control of vehicle and pedestrian traffic with programming and control by infrared remote control. The device is lightweight and easily portable. Messages can be displayed in the color of the normal traffic sign for the condition displayed. An audible message duplicates the message displayed.

6 Claims, 4 Drawing Sheets

Figure 1:
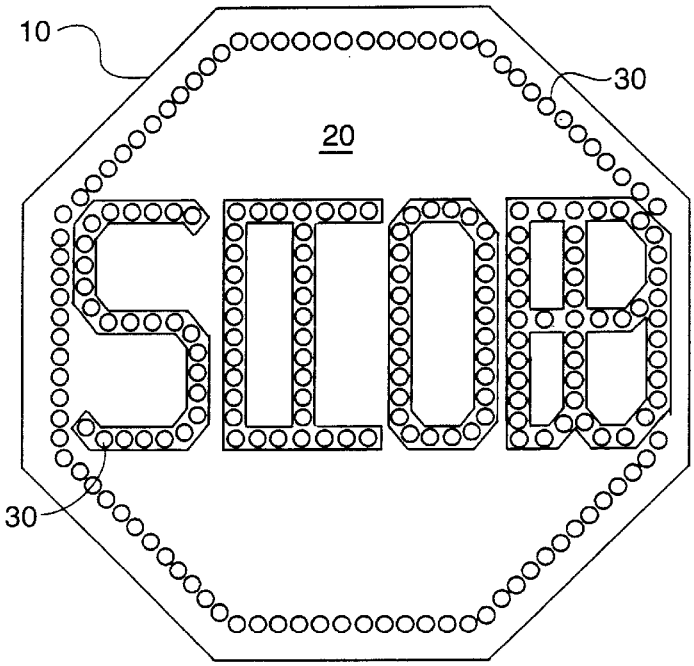

SMART CROSS PROGRAMMABLE VEHICLE AND PEDESTRIAN SIGNAGE WITH ELECTRONIC DISPLAY AND INFRARED REMOTE CONTROL

RELATED APPLICATIONS

This application relates to a Provisional Application No. 60/097425, filed on Aug. 20, 1998, by the same inventor.

BACKGROUND OF THE INVENTION

1. Field of the Invention

The present invention relates generally to the field of signs for the control of pedestrian and vehicle traffic and more specifically to the field of signs for the control of traffic with an electronic display which can be programmed remotely to change the message which is displayed.

2. Description of the Prior Art

The field of devices which control pedestrian and vehicle traffic has been studied extensively and a number of approaches have been developed. This field is important because without clear and visible direction, collisions can occur between vehicles and between vehicles and pedestrians resulting in personal injury, loss of life, or property damage. This is especially true in high traffic areas such as construction areas and areas adjacent to schools. Even though the need to provide adequate control of traffic is well defined, the approaches to the control of pedestrian and vehicle traffic are diverse and varied.

One example is disclosed in U.S. Pat. No. 2,564,170 issued to Nusbaum, et al. This device is portable, it being mounted on wheels, with an electric signal light powered from a battery. The device achieves traffic direction through the use of a sign mounted on the support structure for the light. The light is used to attract attention to the message of the sign.

Another example is disclosed in U.S. Pat. No. 2,612,548, issued to Swanson. The device is portable and achieves traffic direction through the use of printed messages facing traffic and an electric light to attract attention to the message of the sign.

In U.S. Pat. No. 3,867,718, issued to Moe, a pair of signal-display units is used to control traffic by changing the traffic condition indication of the signal-display units. Remote control of the pair of signal-display units is achieved through the use of a radio frequency transmitter controlled by an operator and individual receivers at each signal-display unit. The units are portable.

A hinged-panel portable traffic control device is found in U.S. Pat. No. 4,226,040 issued to Carroll, et al. The device displays a single message for traffic control and is not lighted.

Another hinged-panel portable traffic control device is found in U.S. Pat. No. 4,928,415, issued to Walters. The device provides for visual messages on the faces of the hinged panels. By reversing the panels, messages which have been imprinted on the reverse side of the panels are exposed, thus providing for a change in the visual message which is displayed. The device is not lighted.

Still another hinged-panel portable traffic control device is found in U.S. Pat. No. 4,999,937, issued to Bechtold. The device can display multiple messages by manually replacing signage attached to the faces of the device. The device is not lighted.

A pedestrian crossing safety apparatus is disclosed in U.S. Pat. No. 5,023,607, issued to Staten. The device consists of a STOP message surrounded by a border of battery-operated, selectively flashing lights to direct attention to the message.

In U.S. Pat. No. 5,422,638, issued to Singer, et al., a portable traffic control sign is disclosed which consists of a sign mounted on pole which can be rotated 180 degrees between two positions. The message displayed to traffic facing the sign can be changed between the messages displayed on the respective front and back faces of the sign. An electrical cable connecting the sign to a switch unit held by the operator remotely controls the rotation of the sign. The sign is not lighted.

Another portable traffic control sign selectively displaying one of two messages is disclosed in U.S. Pat. No. 5,493,292, issued to Fanslow, et al. In this device a panel with the message to be displayed is moved to a superimposed position overlaying the other panel containing the second message. In a one-way construction zone, a timer portion of the device alternately selects between slow and stop messages so that a pair of the devices can provide control of traffic without the presence of an operator. The sign is not lighted.

Thus, a variety of portable signs which control pedestrian and vehicle traffic is known. Most of the devices make provision for changing the traffic control message displayed by the device. However, the number and combination of messages is severely limited and in most cases difficult to select. Only one of the above-referenced devices allows an operator to remotely select the message displayed. In that case an electrical cable was required to connect a control in the hands of an operator with the portable sign to effectuate a change in displayed message.

Accordingly, it would be desirable to develop a portable traffic control sign using a highly visible electronic display which could be remotely controlled to display a number of messages as selected by an operator utilizing a remote control which does not require an electrical connection between the sign unit and the control in the hands of the operator.

SUMMARY OF THE INVENTION

In view of the foregoing disadvantages inherent in the known types of portable traffic control devices, the present invention makes available a remotely programmable and adaptable traffic control device which provides all of the features afforded by the prior art while at the same time providing better visibility and consequently greater safety.

To achieve this goal, the present invention provides an improved method of signaling pedestrians and drivers of vehicles and/or equipment to temporary dangerous conditions. The invention comprises a portable lightweight base and stand assembly and a self-contained electronic display. The electronic display of the smart cross sign can signal many combinations of messages describing DANGER, SLOW, DIRECTION (using arrows pointing in the proper direction), CAUTION, or STOP conditions to drivers and pedestrians. The electronic display can be controlled from a remote position by an infrared signal. Further, the electronic display can be programmed to sequentially display a variety of lighted electronic messages to front and back surfaces of the sign in colors identifiable with the message. This can include different messages displayed and controlled by monitoring personnel for vehicles and/or pedestrians approaching or crossing in opposing directions. The electronic sign messages are made highly visible in sunlight or darkness by the use of ultraviolet blocker coatings applied to a surface of the otherwise clear plastic sign covering. Monitor personnel can stand vigil from positions as remote as one hundred feet. When the situation warrants, monitor personnel can switch the display message from one message to another with a hand-held infrared controller. In addition to switching the display messages, the infrared controller can also be used to trigger repeated light and sound signals at each side of the sign. By selecting this condition for the smart cross sign, monitor personnel can advise traffic of safe or unsafe pedestrian crossing conditions.

In another embodiment of the present invention, a mounting structure is provided to mount the smart cross sign on an existing vertical or horizontal support structure.

BEST MODES FOR CARRYING OUT THE INVENTION

The preferred embodiment of the present invention can be best understood by reference to the drawings. FIG. 1 is a front view of the display portion of the invention configured for a stop/slow traffic control function such as might be used at construction site where traffic was being diverted into a single lane of traffic in both directions at alternate times. Referring to FIG. 1, light emitting diodes 30 are illuminated in a pattern such that the proper traffic control message is displayed. The walls of enclosure 10 support the transparent front face 20. In the preferred embodiment of FIG. 1, the words STOP and SLOW are alternately displayed by illuminating the proper combination of light emitting diodes 30. In addition, the light emitting diodes 30 are illuminated in such a way as to form an outline in the shape of an octagon to draw attention to the message displayed on the sign.

Figure 2:
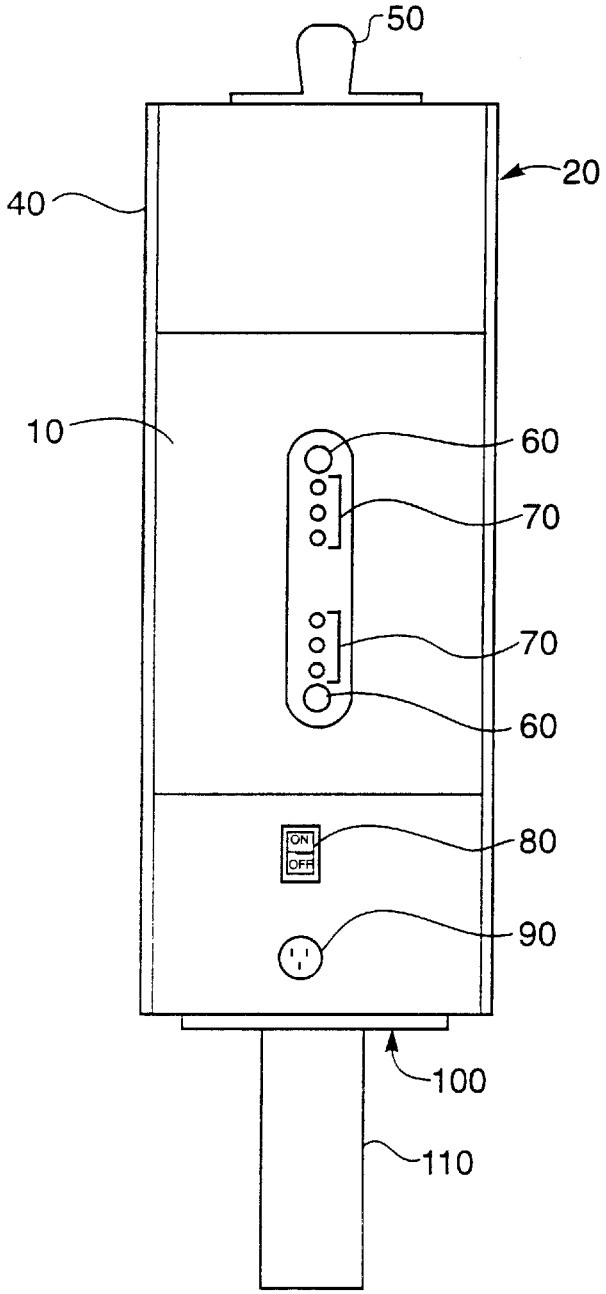

FIG. 2 is a side view of the display portion of the preferred embodiment. Referring to FIG. 2, the side walls of enclosure 10 support the transparent front face 20 and an opaque back face 40. A handle 50 is attached to the top wall of enclosure 10 and provides a means for carrying the invention from location to location. An infrared detector 60, operator signal lights 70, on/off switch 80, and a receptacle 90 for an external battery charger are located in the side wall of enclosure 10. A mounting plate 100 is attached to the bottom wall of enclosure 10. Support tube 110 is attached to mounting plate 100.

Figure 3:
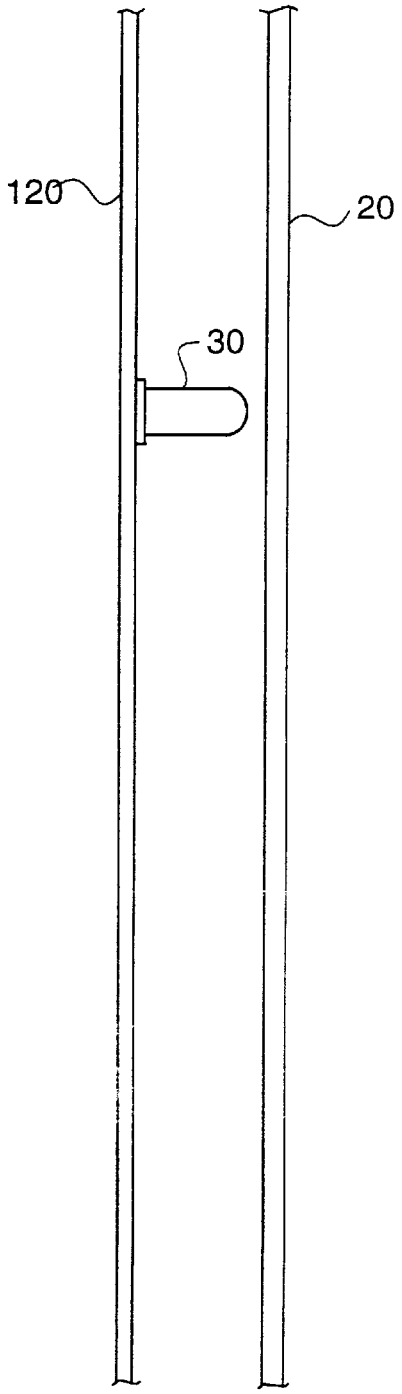

FIG. 3 is a cross-sectional view through the display portion of the preferred embodiment of the invention. A typical light emitting diode 30 is shown mounted on the printed circuit board portion of digital electronic control 120. Transparent front face 20 covers and protects light emitting diodes 30.

Figure 4:
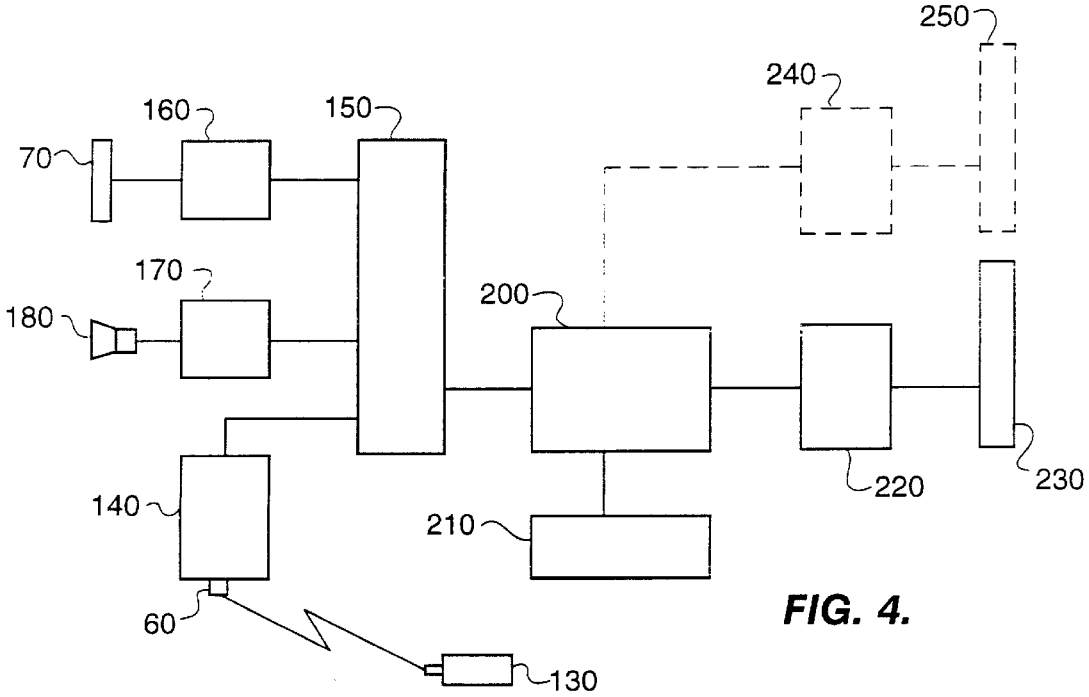

FIG. 4 shows a block diagram of the digital electronic control 120 of the preferred embodiment of the invention. Referring to FIG. 4, monitor personnel input commands to the invention through the means of infrared remote control transmitter 130. Infrared remote control transmitter 130 is also used to supply programming to the preferred embodiment of the invention. The infrared signal produced by infrared remote control transmitter 130 is received by infrared detector 60. The infrared detector 60 is connected to an infrared receiver 140. The signal from the infrared receiver 140 is supplied to digital input/output portion 150 of digital electronic control 120. The operator display 70 is connected to digital input/output 150 through display driver 160. An audio transducer 180 is also connected to digital input/output 150 by means of an audio driver 170. All input/output functions, programming, and display functions are under the control of microprocessor 200. The digital programs for the control of the preferred embodiment of the invention are stored in digital storage 210 which is connected to microprocessor 200. Digital display 230 consists of a plurality of light emitting diodes 30 and is connected to microprocessor 200 by means of digital display driver 220. An additional digital display 250 and digital display driver 240 are shown for the optional configuration of the preferred embodiment where the opaque back cover 40 is replaced by a second digital display and transparent cover.

Figure 5:
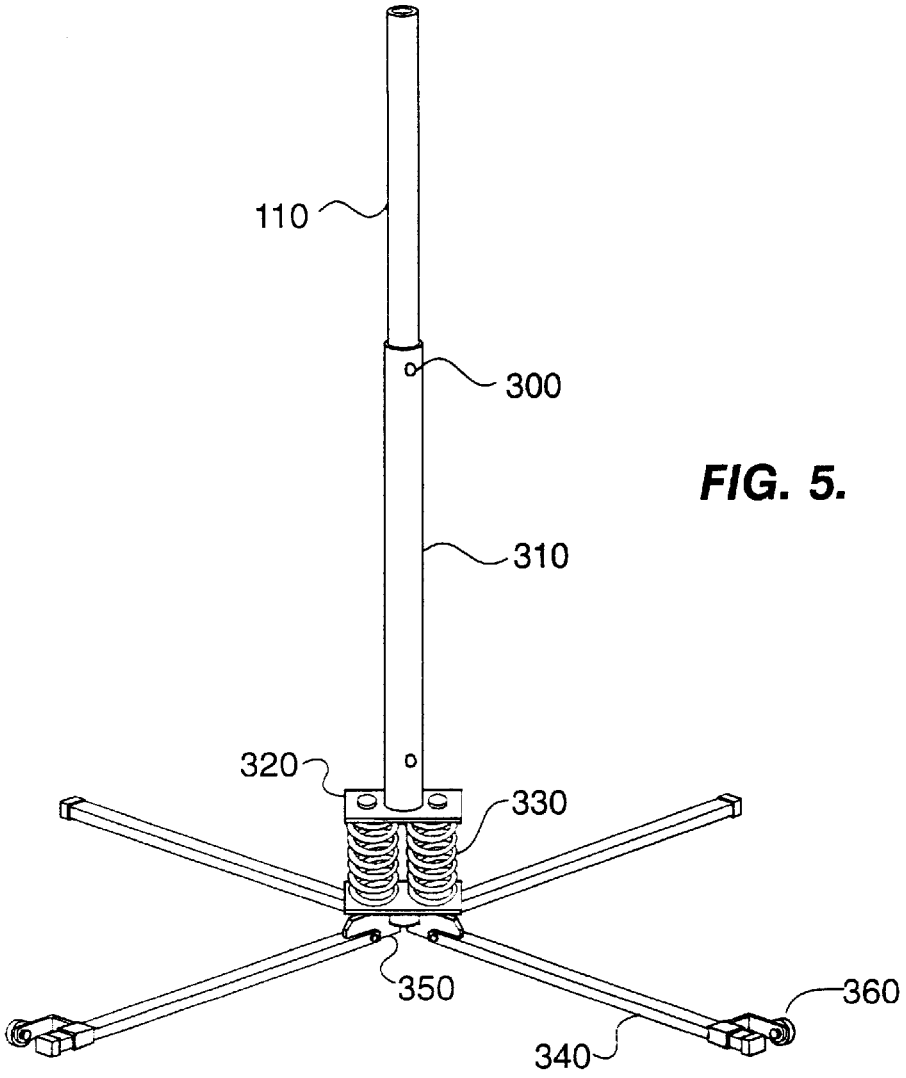

FIG. 5 shows the support tube and base of the preferred embodiment of the invention. Referring to FIG. 5, support tube 110 which connects to enclosure 10 slides inside outer tube 310 to allow for adjustment of the height of the invention. Locking device 300 secures support tube 110 at the selected height. The lower end of outer tube 310 is attached to springs 330 by means of mounting plate 320. Springs 330 are in turn mounted to base 350. Foldable legs 340 shown in an extended position are attached to base 350 and provide stable support for the invention. Optional wheels 360 mounted on legs 340 are mounted in such a way that when the invention is tilted, the wheels 360 engage the ground and allow the invention to be easily moved.

Figure 5A:
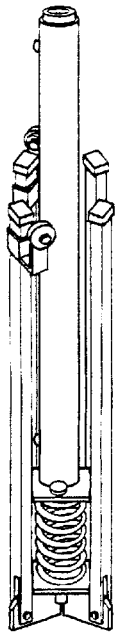
Figure 6:
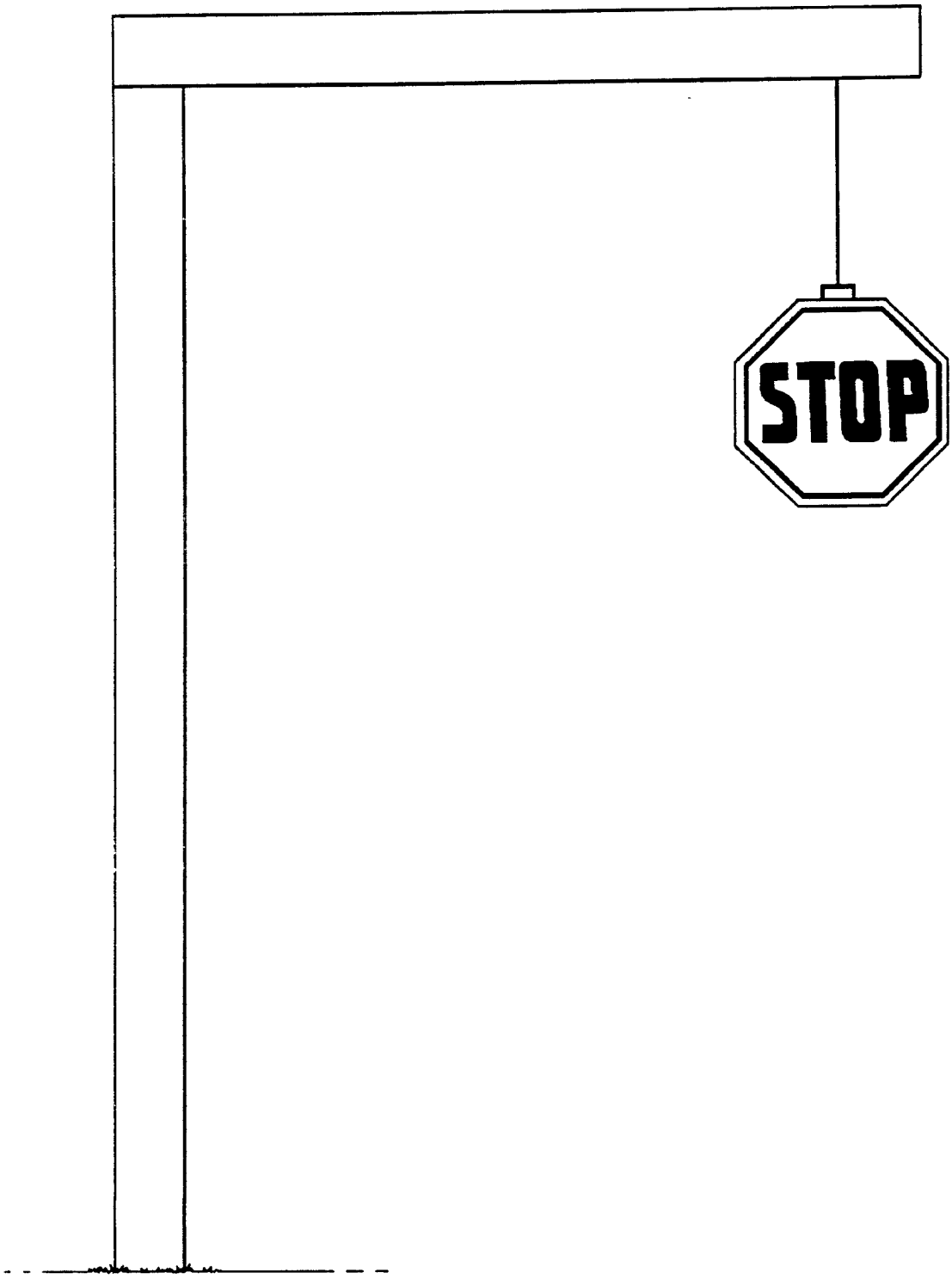

FIG. 5A shows the legs 340 in a folded position. FIG. 6 shows the preferred embodiment of the invention mounted on an overhead horizontal support structure such as might be encountered in existing traffic control installations.

Although only one embodiment of the present invention is set forth herein, it would be apparent to someone skilled in the art that various changes and modifications may be made without departing from the spirit of the invention, and all such changes and modifications are considered to fall within the scope of the invention as defined by the appended claims. For example, the messages displayed may take virtually any form which can be defined by letters, numbers or symbols. Further, the display may be steady or flashing. An audible message may or may not be present. The shape of the display may match the shape of the traffic control sign for the condition displayed or the display may take on a simple rectangular shape.

What is claimed is:

1. A portable programmable vehicle and pedestrian traffic control sign, said traffic control sign comprising:

an electronic display means having a plurality of light emitting diodes which can be either energized or not energized in such a fashion as to form various letters of the alphabet or special symbols;

a digital electronic control means having input and output modules, a microprocessor to accept digital inputs and to process digital inputs according to operational program steps, and a display driver to control the operation of the light emitting diodes of the electronic display;

a digital storage means for storing digital programs which control the operation of the microprocessor;

an infrared receiver means to receive infrared signals from a remote infrared transmitter and convert such signals into digital signals supplied to the digital electronic control;

an infrared transmitter means to convert push button operator inputs into infrared control signals which are transmitted to the infrared receiver;

an electrical power means to provide electrical power to the electrical components of the sign;

an enclosure means consisting of a front face transparent to the passage of light from the illuminated light emitting diodes of the electronic display, an opaque back face, two opaque side walls, an opaque top wall and an opaque bottom wall joined in such a manner as to provide a dust free and weatherproof environment for the electrical and electronic components of the sign;

a support tube extending from bottom wall of the enclosure of sufficient length to elevate the electronic display for greater visibility; and a base means attached to the support tube and having attached legs extending outward radially from the center of the base and lying in a horizontal plane to provide a stable platform for the sign.

2. The traffic control sign of claim 1, wherein the electronic display means consists of light emitting diodes of a plurality of colors such that the letters and symbols formed by the electronic display can be made to appear in the normal color of the safety condition displayed.

3. The traffic control sign of claim 1, wherein the transparent front face of the enclosure includes an ultraviolet coating to reduce glare and to enhance the visibility of the display.

4. The traffic control sign of claim 1, wherein the sign includes an audio transducer mounted in a side wall of the enclosure and under the control of the microprocessor to produce audible messages duplicating the message displayed on the electronic display.

5. The traffic control sign of claim 1, wherein the opaque back face of the enclosure is replaced by a translucent back face and a second electronic display under the control of the microprocessor such that a second message can be simultaneously displayed in a direction directly opposite to that of the first display.

6. The traffic control sign of claim 1, wherein the support structure includes a universal clamping structure to replace the base which allows the sign to be clamped to an existing vertical or horizontal pole or traffic control support structure.

* * * * *